US005987665A

United States Patent [19]

Simantob et al.

[11] Patent Number: 5,987,665

[45] Date of Patent: Nov. 23, 1999

[54] COLLAPSIBLE AND CONVERTIBLE COMBINATION BABY BED AND BABY CARRIER SYSTEM WITH ROCKER UNIT

[76] Inventors: Constance P. Simantob, 865 Arapahoe Ave., #1, Boulder, Colo. 80302; Cinda H. Johnson, 3756 Wonderland Hill Ave., Boulder, Colo. 80304

[21] Appl. No.: 08/961,376

[22] Filed: Oct. 30, 1997

Related U.S. Application Data

[63] Continuation-in-part of application No. 08/653,413, May 24, 1996, Pat. No. 5,819,341.

[51] Int. Cl.[6] ..... A47D 9/04; A47D 9/00

[52] U.S. Cl. ..... 5/98.3; 5/101; 5/102; 297/273

[58] Field of Search ..... 5/98.3, 108, 102, 5/103, 104, 127; 297/273, 274; 482/66, 69

[56] References Cited

U.S. PATENT DOCUMENTS

| | | | |
|---|---|---|---|
| 16,150 | 12/1856 | Robbins | 482/69 |
| 505,797 | 9/1893 | Wastall | 5/98.3 |
| 659,487 | 10/1900 | McMurdy | 5/104 |
| 871,692 | 4/1907 | Gray | 5/104 |
| 888,045 | 5/1908 | Shaw | 5/104 |
| 1,403,552 | 1/1922 | Holmes | 297/273 |
| 4,698,862 | 10/1987 | Mairs | 5/98.1 |

FOREIGN PATENT DOCUMENTS

| | | | |
|---|---|---|---|
| 319514 | 9/1929 | United Kingdom | 5/102 |

*Primary Examiner*—Alexander Grosz
*Attorney, Agent, or Firm*—Davis Graham & Stubbs LLP

[57] ABSTRACT

A collapsible, lightweight, sturdy bassinet-style combination and convertible baby bed and carrier which is also flexible, comfortable, durable, and modular. A fabric basket with a flexible support structure having rounded edges combine to create a soft sided yet semi-rigid and sturdy carrier, and a rocker unit is provided.

16 Claims, 6 Drawing Sheets

COLLAPSIBLE AND CONVERTIBLE COMBINATION BABY BED AND BABY CARRIER SYSTEM WITH ROCKER UNIT

This application is a continuation-in-part of application Ser. No. 08/653,413, filed May 24, 1996, now U.S. Pat. No. 5,819,341.

FIELD OF THE INVENTION

This invention relates to infant care, and more particularly to a light weight, collapsible and convertible combination bassinet style baby bed and baby carrier system. The invention has particular utility for multi-purpose functions. Although it is a stand-alone product as bassinet bed and baby carrier, it is also modular and may be attached to such accessories as a rocker stand, stroller wheels, and an infant automobile seat/bed. The stand-alone product is also convertible into a backpack style baby carrier with an included harness system for proper support.

BACKGROUND OF THE INVENTION

In America alone, there were approximately 4 million babies born in 1994. Many of today's parents are particularly concerned about every aspect of their baby's well being, from safety and nutrition to physical fitness, and many such parents are looking for the next generation of products that are safe, convenient, practical and beautifully designed, and which give parents the peace of mind they are demanding. With a concern for economics as well, a baby bed/carrier system which is convertible and multi-functional would meet these needs in a way not yet satisfied by existing products.

The baby bed and carrier system of this invention includes, at its core, a fully supported (semi-rigid) collapsible, lightweight combination baby bassinet style bed and hand-held baby carrier which is also convertible into a backpack style carrier. The system of this invention makes use of additional modular attachments, including a rocker support unit to create a rocking baby bed, a wheel support unit to create a stroller, and a car seat unit to create a baby car seat.

The overall baby bed and carrier system of this invention is flexible and convertible, comfortable, durable, and modular. It achieves these benefits by using an integrated structure and a combination of features not previously appreciated by other workers in the field, and not shown in any prior product of which the inventors are aware. Prior efforts in this field are illustrated by the following prior patents.

U.S. Pat. No. 385,633 of Kelly et al. shows a rigid baby basket or cradle having a set of rockers on the bottom. The rockers are collapsible against the bottom of the baby basket.

U.S. Pat. No. 3,096,917 of Gudiksen discloses a collapsible baby basket having an upper frame including a rigid rectangle formed by metal tubing, a lower frame including a rigid rectangular board, and downwardly folding side walls.

U.S. Pat. No. 4,698,862 of Mairs shows a combination bassinet, baby carrier and diaper bag. The Mairs bag includes a collapsible shell which can be partially closed for use as a tote bag and which can be expanded to a fully open position, including the use of a pair of removable rods to impart a degree of rigidity to the open position, for use as a baby basket. A sheet doubles as both a liner for the baby basket when the structure is used for that purpose, and as a body pack to strap a baby to the torso of an adult wearer when used as a baby carrier.

U.S. Pat. No. 4,717,056 of Carmichael describes a soft-sided infant carrier including a cloth shell having a bottom which curves downwardly and a foam rubber piece of a semi-oval shape which, together with a plastic insert in the front portion of the shell, helps to support the inside of the shell along the bottom and sides of the shell and helps to hold the cloth shell away from the baby's face.

Other collapsible or folding baby baskets, cribs, cradles or beds are shown in U.S. Pat. No. 823,321 of Dejonge; U.S. Pat. No. 1,412,177 of Glaum; U.S. Pat. No. 2,622,250 of Coles (a collapsible baby crib with a wire frame stand, a removable rigid bottom piece, a pair of rigid rods with one each disposed along each of the two long top sides, and two rigid end pieces at either end to receive the rods); U.S. Pat. No. 3,090,634 of Hesketh et al. (a baby carriage convertible to a cradle having collapsible wire rockers under the wheels of the carriage/cradle); U.S. Pat. No. 5,096,260 of Hagerstrom; and U.S. Pat. No. 5,170,520 of Milliken.

Despite all the prior efforts, no one has yet developed a baby bed and carrier system which includes a fully supported (semi-rigid) collapsible, lightweight combination baby bassinet style bed and hand-held baby carrier which is also convertible into a backpack style carrier. Nor has such a combination bed and carrier been incorporated into a modular system including a rocker support unit and a wheel support unit so that the same bed and carrier may also become an integrated part of the baby's rocker and stroller. It would be highly desirable to create such a product. Moreover, it would be desirable if such a combination bassinet style baby bed and carrier were also:

- lightweight and easily portable so that the bed function does not sacrifice the baby carrier function (that is, the desirable product should be under 3 pounds in weight, properly balanced for carrying, and supported so that the child's mother can carry it by the handle, free swinging at her side or over her shoulder with the baby inside);
- comfortable and inviting to the infant as a semi-rigid bed so that the baby carrier function does not sacrifice the baby bed function (that is, the bed should be framed and supported with sufficient rigidity that the baby would be happy and content inside it for extended periods of time, including not only at home, but on airplanes, in restaurants, in offices, in hotels, in churches and other public places, and in the homes of friends and relatives; in short, the desirable product should be a "real" rigidly supported bed in which an infant can comfortably rest for extended periods of time);
- durable and long lasting so that the light weight carrier function does not sacrifice the heavy duty materials that would make the product last (that is, the product should not be of flimsy construction, but should be one which a baby could use almost constantly for at least the first 12 months of life and on occasion during the next several years; in short, the desirable product should be of solid construction built to last under constant use for at least the infant's first year, and should still serve as a bed or napping place for the growing toddler and young child up to 60 pounds);
- convertible from one mode of use to another so that the benefits of the product are not sacrificed to cost and a single system can accomplish multi-purpose use for the family (that is, the desirable product should be not only a combination bassinet bed and baby carrier, but it should be flexible and convertible so that with an included harness system which properly supports the infant, the hand-held carrier converts to a backpack style carrier); and modular and multifunctional further to reduce the overall cost and duplication of using separate products for similar functions (that is, the desirable product should be part of a system that can be used with available accessories as the focal point of the parent's needs for several products, thereby helping to eliminate duplicative purchases of several products; the desirable system should be multifunctional and have "clip on" compatibility to a range of accessories, including rockers, wheels, stands, car seats and others so that a single core product and system can be the foundation upon which, by modular attachments, such multi-purpose uses as strollers, rockers, cribs, and car seats can be added on at a savings relative to buying a completely separate product for each use, and without wasteful duplication of production resources).

The lightweight, collapsible and convertible combination baby bed and carrier system of this invention uses fiberglass rods to impart rigidity, yet collapses to 30 inches by 12 inches by 3 inches and weighs approximately 2.5 pounds. It uses adjustable-length, ergonomically engineered handles for balance in the hand-held carrier mode and for ease of carrying in a free swinging manner at an adult's side, or over the shoulder.

The bed and carrier system is semi-rigid, and the fiberglass frame and fabric structure allows it to carry up to 60 pounds. The system converts from a hand-held (or over the shoulder) style to a baby backpack style carrier, using a harness system for proper support. The bed and carrier system of this invention is modular, and has clip-on compatibility with a number of other accessories so that it can function as rocker, stroller, or car seat. The bed and carrier, although semi-rigid, is soft sided to create a comfortable womb-like environment for an infant and, in a preferred embodiment, includes such comfort features as a sheepskin lining and reversible fitted colored and patterned sheets.

It is, thus, the intent of this invention to solve the problems not yet addressed by the prior art in a combination baby bed and carrier which is at the same time lightweight, comfortable, durable, convertible, modular and multifunctional. These and other advantages of the convertible combination baby bassinet bed and carrier system of this invention will be described in more detail in the description which follows.

SUMMARY OF THE INVENTION

The lightweight, collapsible and convertible combination baby bed and carrier system of this invention includes a soft and flexible basket having an elliptical or oval-shaped bottom from which a side wall extends upwardly. The soft basket is, preferably, constructed of fabrics such as 100% natural cotton canvas (for warm weather use) or 1000 dernier nylon CORDURA (for cold weather use) or 600 dernier polyester, The perimeter of the ellipse at the bottom of the basket includes a bottom perimeter channel or pocket into which at least one flexible and bendible bottom perimeter rod is inserted to maintain the elliptical shape of the basket's bottom. In a preferred embodiment, the channel is a hollow plastic welt into which is inserted one or more continuous 1/16 inch diameter fiberglass bottom perimeter rod(s). The bottom perimeter rods provide a structured, semi-rigid yet soft bottom perimeter shape to the basket.

Taking, for purposes of description, a first line drawn between the foci of the elliptical bottom, and a second line drawn normal to the first line, the bottom of the basket can be understood also to include a number of cross-member channels or pockets which run parallel to the second line, spaced apart from one another. A number of cross-member rods are removably inserted into the cross-member channels to provide structural support, shape and stiffness to the bottom of the basket. In a preferred embodiment, three fiberglass rods are used as the cross-member rods. The cross-member rods provide a semi-rigid structure to the bottom of the basket. The required tensile strength is provided economically and with light weight and relatively small dimension.

The basket has not only an elliptical bottom, but also, as the basket's wall extends upwardly therefrom, an elliptical top. The perimeter of the ellipse at the top of the basket includes a top perimeter channel or pocket into which at least one flexible and bendible top perimeter rod is inserted to maintain the elliptical shape of the basket's top. In a preferred embodiment, the top perimeter channel is contained in a contrast cording which encloses a hollow plastic welt into which are inserted two 1/16 inch fiberglass top perimeter rods centered on the head and foot center seams and stopping approximately two inches beyond the radius point whereat a pair of 1/8 inch fiberglass rods are inserted (one at each side) on both of the long sides of the basket behind a VELCRO hook and loop fastener. The top perimeter rods provide a structured, semi-rigid shape to the basket. The 1/8 inch rods keep the sides from bowing out.

A number of generally vertical sidewall upright spacer channels or pockets are carried by the sidewall, running between the top and the bottom of the sidewall. A number of sidewall upright spacer rods are removably inserted into the sidewall channels from the bottom of the basket to provide shape and stiffness to the sides of the basket, and to space the top away from the bottom of the basket. They provide a semi-rigid yet still soft sidewall structure to the basket.

In a preferred embodiment, four vertical upright spacer channels are provided in two pairs of two each. The first pair of upright channels is located with one upright channel each at the head and foot of the basket (that is, considering the elliptical perimeter of the bottom of the basket, the two points where a first line drawn through the foci intersects the perimeter of the bottom), and the second pair of upright channels is located with one upright channel each at the left and right of the basket (that is, considering the perimeter of the bottom of the basket, the two points where a second line drawn normal to the first line through the mid-point of the first line intersects the perimeter). In a preferred embodiment, the sidewall channels are vertical and normal to the plane of the bottom, and the sidewall upright spacer rods are fiberglass.

Attached at or about the top perimeter of the side wall of the basket is a quilted top cover. In a preferred embodiment, one or two access zippers run parallel to the side wall and approximately the length of the top cover for access to the inside of the basket. The access zippers open the top cover so that the baby can be put into the basket, and then the access zippers close the top cover so that the baby can be kept warmly and securely in the basket.

A removable, reversible quilted mattress pad and sheet combination, including a zippered flannel cover over a foam pad, may be placed on the bottom of the basket. In a preferred embodiment, a 3/4 inch convoluted fire retardant foam mattress is covered by rip stop nylon and zippered into a custom fit sheet which enables the mattress to be flipped from flannel to sheeting. The interior of the sidewalls of the basket is cotton with interesting visual designs imprinted thereon. The interior of the top cover is similarly cotton lined and quilted for warmth, comfort, protection from the elements and insulation from sounds and temperature extremes. All zippers and channels are covered with fabric flaps or are sewn into the body of the material. Optionally, a precut sheepskin or other comfortable lining can be inserted into the basket, and a quilted semi-rigid flexible rod reinforced bonnet/hood can be installed above the head of the basket for additional sound insulation and warmth. Interior pockets hold keys, bottles and diapers; loops are provided for toy clip-ons; VELCRO brand hook and loop fasteners may secure such things as mirrors or toys within the basket.

A pair of carrying straps, one strap on the left and one strap on the right side of the basket, run from the bottom of the basket. The straps are adjustable-length, and sized and positioned slightly asymmetrically to one another, advantageously to provide a balanced grip when the basket is carried free swinging at an adult's side or over the shoulder. Furthermore, a grip made of the same fabric as the carrier can be slid along one handle and closed with, for example, a VELCRO brand hook and loop fastener over the opposite handle to ensure a balanced carry point. The carrying straps are adjustable and can also be removed (unclipped) or reconfigured to permit the combination baby bed and carrier to be strapped backpack or papoose-style to an adult's back; in addition, a removable adult harness which mates to the combination baby bed and carrier can also be used for this purpose. A removable infant harness provides proper support to the infant for carrying when the system is converted to backpack carrier mode.

A modular, removable rocker stand may be added. In one style, the rocker stand is formed by the insertion of flexible bottom rocker rods into pockets on the bottom of the basket, with a number of support and spacing rods running between the rocker rods so that the bed rocks from head to foot. In another style, the rocker stand is formed by bowing a number of rocker rods across the bottom so that the bed rocks from side to side: in this style, curved metal radiused ends with swivel hooks are attached to the ends of the rocker rods with a screw, enabling the basket to be clipped in. The radius rocker rods are held rigid by two cross-members which are easily unscrewed for ease in portability.

A modular, removable wheeled base may be added. In one version, a three-wheeled stroller base clips to the bassinet bed so that the system of this invention becomes an integral part of a stroller. Additional accessory kits include, for example, stroller wheel sets which are interchangeable, using a quick release system, from a six inch (or smaller) diameter size to a twenty inch (or larger) alloy rim for jogging.

It can now be better understood that the lightweight, collapsible and convertible combination baby bed and carrier of this invention uses fiberglass rods to impart rigidity, yet collapses to 30 inches by 12 inches by 3 inches (or smaller) and weighs 2.5 pounds or less. It uses specially balanced handles for ease of carrying in a free swinging manner at an adult's side or over the shoulder. It is soft sided yet semi-rigid and creates a comfortable womb-like environment for an infant and, in a preferred embodiment, includes a sheepskin lining. Its strong fiberglass cross-members, acetyl plastic hardware, seat belt web handles, and fabric construction allow it to carry up to 60 pounds. It converts to a baby backpack style carrier so that the baby may be strapped to the parent's back and carried that way as well. It is modular, and has clip-on compatibility with a number of other accessories so that it can function as the core of a rocker, stroller, crib or car seat/bed. These and other features of the invention will be explained in connection with the drawings and the detailed description which now follow.

DETAILED DESCRIPTION OF THE INVENTION

Figure 1:
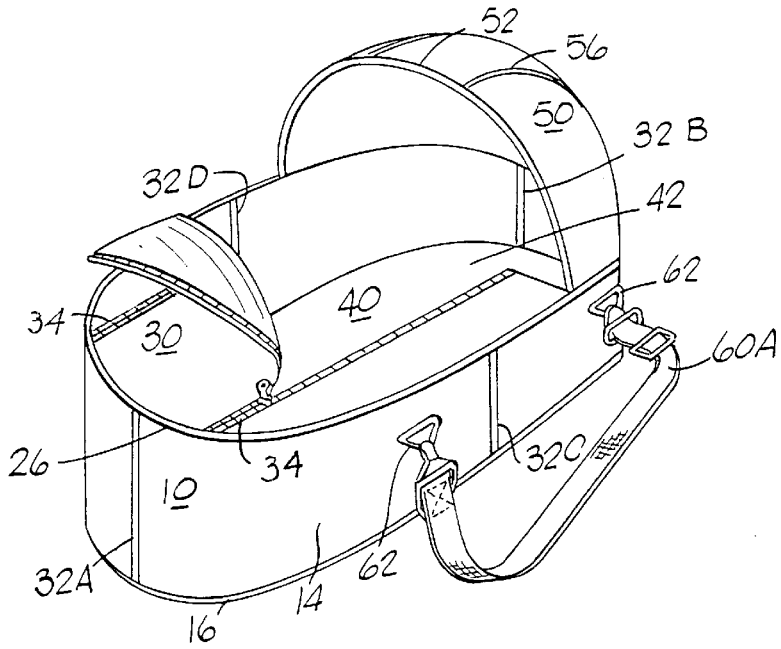
FIG. 1 is a perspective view of the combination bed and carrier of this invention.
Figure 2:
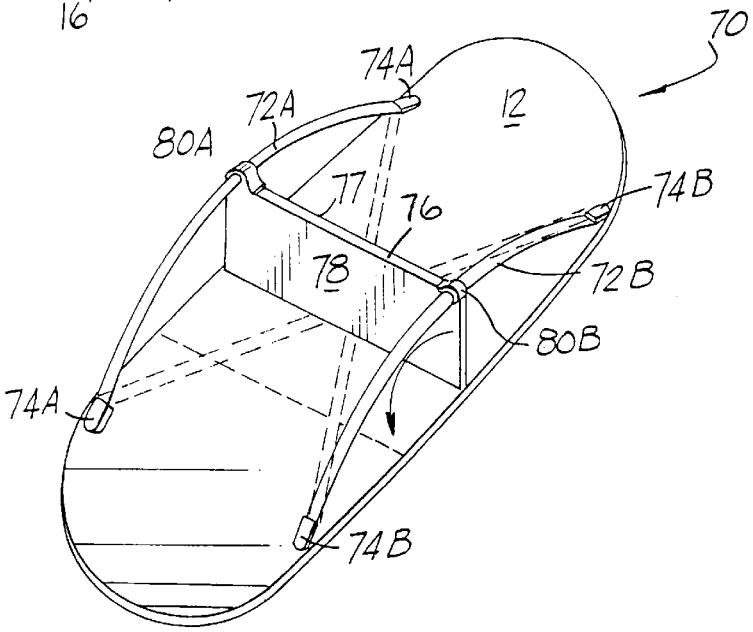
FIG. 2 is a bottom perspective view, showing a first embodiment of the modular rocker stand.
Figure 3:
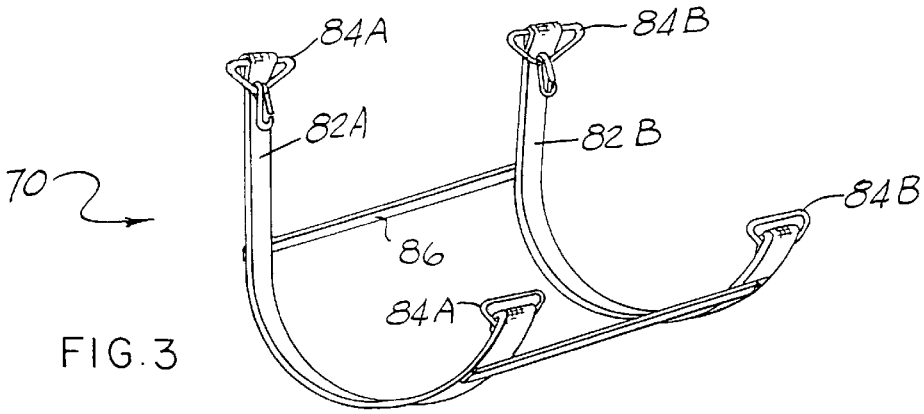
FIG. 3 is a perspective view, showing a second embodiment of the modular rocker stand.

With reference to FIG. 1, it may be seen in overview that the collapsible and convertible combination baby bed and carrier system of this invention includes a basket 10, a top cover 30, a mattress pad and sheet unit 40, a bonnet 50, a set of straps 60, and a rocker stand 70 (reference FIGS. 2 and 3). AS will be explained, not all of the foregoing features are essential to the baby carrier of this invention, but in various combinations illustrate a preferred embodiment.

Figure 6:
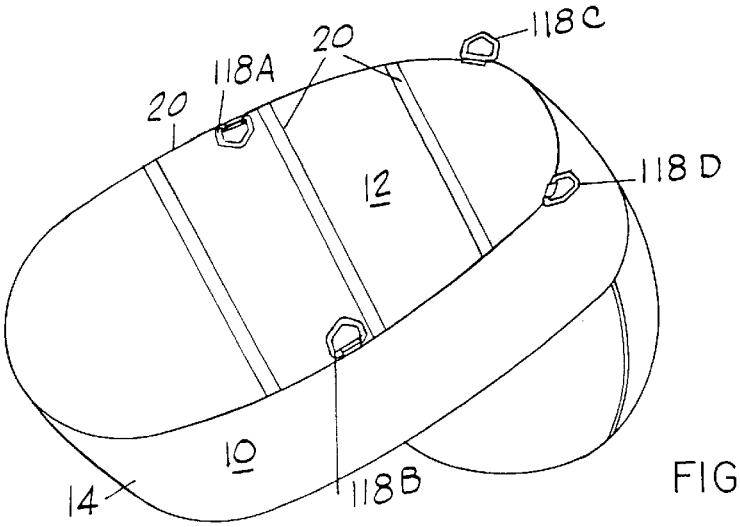
FIG. 6 is a perspective, bottom view of the combination bed and carrier of this invention, showing details of the exterior for attachment of the removable adult harness for carrying the bed and carrier when converted to backpack mode.

Referring to FIG. 6, it may be seen that basket 10 has an elliptical or oval-shaped bottom 12 from which a sidewall 14 (see FIG. 1) extends upwardly. The basket 10, including its bottom 12 and sidewall 14, is soft and, preferably, constructed of fabrics such as 100% natural cotton canvas (for warm weather use) or 1000 dernier nylon CORDURA (for cold weather use) or 600 dernier polyester.

The perimeter of the ellipse at the bottom 12 of the basket includes a bottom perimeter channel or pocket 16 into which at least one flexible and bendible bottom perimeter rod 18 (not separately numbered or visible in the drawing, but understood to be contained within channel 16) is inserted to maintain the elliptical shape of the basket's bottom. In a preferred embodiment, the channel 16 is a hollow plastic welt into which is inserted one or more continuous 1/16 inch diameter fiberglass bottom perimeter rod(s) 18.

Taking, for purposes of description, a first line drawn between the foci of the elliptical bottom of the basket 10, and a second line drawn normal to the first line, the bottom 12 of the basket 10 can be understood also to include a number of cross-member channels or pockets 20 (see FIG. 6) which run parallel to the second line, spaced apart from one another. A number of cross-member rods 22 (not separately numbered or visible in the drawing, but understood to be contained within channels 20) are removably inserted into the cross-member channels 20 to provide shape and stiffness to the bottom of the basket. In a preferred embodiment, three 1/4 inch fiberglass rods 22A, 22B, and 22C (not shown) are used as the cross-member rods 22. The cross-member rods 22 provide a rigid, yet still soft planar structure to the bottom 12 of the basket 10.

With reference again to FIG. 1, it may be understood that basket 10 has not only an elliptical bottom 12, but also, as the basket's sidewall 14 extends upwardly therefrom, an elliptical top. The perimeter of the ellipse at the top of the basket includes a top perimeter hollow welt channel or pocket 26 into which at least one flexible and bendible top perimeter rod 28 (not separately numbered or visible in the drawing, but understood to be contained within channel 26) is inserted to maintain the elliptical shape of the basket's top. In a preferred embodiment, the top perimeter channel 26 is contained in a contrast cording which encloses a hollow plastic welt into which are inserted two 1/16 inch fiberglass top perimeter rods 28 centered on the head and foot center seams. It is possible to use a pair of 1/8 inch fiberglass rods 28A, 28B (not shown) as the top perimeter rods 28 at the sides of the perimeter, and another pair of 1/16 inch fiberglass rods 28C, 28D (not shown) as the top perimeter rods 28 at the ends of the perimeter. The top perimeter rods 28 provide a structured, semi-rigid yet soft top perimeter shape to the basket 10. The 1/8 inch side rods 28A, 28B keep the sides from bowing out.

A number of generally vertical sidewall upright spacer channels or pockets 32A, B, C, D are carried by the sidewall 14, running between the top and the bottom of the sidewall. A number of sidewall spacer rods 34 (not separately numbered or visible in the drawing, but understood to be contained within upright channels 32) are removably inserted into the sidewall uprights 32 from the bottom of the basket to provide shape and stiffness to the sidewall 14 of the basket, and to space the top channel 26 away from the bottom 12 of the basket 10. They provide a semi-rigid yet still soft sidewall structure to the basket.

In a preferred embodiment four vertical upright spacer channels 32 are provided in two pairs of two each. The first pair of upright channels 32A, 32B is located with one upright channel each at the head and foot of the basket (that is, considering the elliptical perimeter of the bottom of the basket, the two points where a first line drawn through the foci intersects the perimeter of the bottom), and the second pair of upright channels 32C, 32D is located with one upright channel each at the left and right of the basket (that is, considering the perimeter of the bottom of the basket, the two points where a second line drawn normal to the first line through the midpoint of the first line intersects the perimeter). In a preferred embodiment, the sidewall channels are vertical and normal to the plane of the bottom, and the four sidewall spacer rods 34A, 34B, 34C, 34D (not shown) are 3/8 inch flat by 3 mm fiberglass battens.

In the foregoing description of the basket 10, it should be understood that the bottom perimeter channel 16, bottom cross-channels 20, top perimeter channel 26, and sidewall channels 32 may be formed in a number of ways. The channels might be formed by a loop of fabric, sewn into the basket 10, and they might be opened at an end thereof, or opened along the length thereof (as by a VELCRO hook and loop or other suitable fastener) for the insertion and removal of the associated rods.

With reference still to FIG. 1, the top cover 30 is seen to be sized to fit the interior of the basket 10. The top cover 30 includes access zippers 34 roughly bisecting the cover lengthwise(although zippers are shown as the preferred embodiment, it should be understood that any suitable attachment could be used, including VELCRO hook and loop fasteners, buttons and any similar mechanism).

It may be understood that the top cover 30 is attached to the inside of the sidewall 14 of basket 10 at or about the top perimeter of the sidewall of the basket. The top cover 30 might be removably attached to the foot and the sides of the basket 10 by attachment zippers 32 (not separately shown or numbered in the drawings). It can be understood that access zippers 34 open the top cover 30 so that the baby can be put in the basket 10, and then the access zippers 34 close the top cover 30 so that the baby can be kept warmly and securely in the basket.

The mattress pad and sheet unit 40 comprises a removable, reversible quilted mattress pad and sheet combination. A zippered (or otherwise openable) quilted flannel cover 42 is used to cover a foam pad 44 (not separately shown or numbered in the drawings). In a preferred embodiment, a 3/4 inch convoluted fire retardant foam mattress pad 44 is covered by fire retardant rip stop nylon and zippered into a custom fit sheet which enables the mattress to be flipped from flannel to sheeting. With reference to FIG. 1, it can be understood that the pad and sheet unit 40 is placed on the bottom 12 of the basket 10. The size of the basket is appropriately set so that a baby may lie upon the mattress and sheet unit 40, comfortably beneath the top cover 30.

In order to better fashion a combination baby bed and carrier according to this invention, the inventors have found the following recommendations to be valuable. The interior of the sidewalls 14 of the basket 10 may be cotton or vinylized cotton, removable with perimeter VELCRO hook and loop fasteners (for durability and easy cleaning) with interesting visual designs imprinted thereon (for the visual enjoyment of the baby). The interior of the top cover 30 may be cotton lined and quilted for warmth and comfort. Zippers and channels may be covered with fabric flaps, and/or secured by VELCRO hook and loop fasteners, and/or are sewn into the body of the material. Optionally, a precut sheepskin or other comfortable lining can be inserted into the basket, above the mattress and sheet unit 40 and below the top cover 30.

Figure 7A:
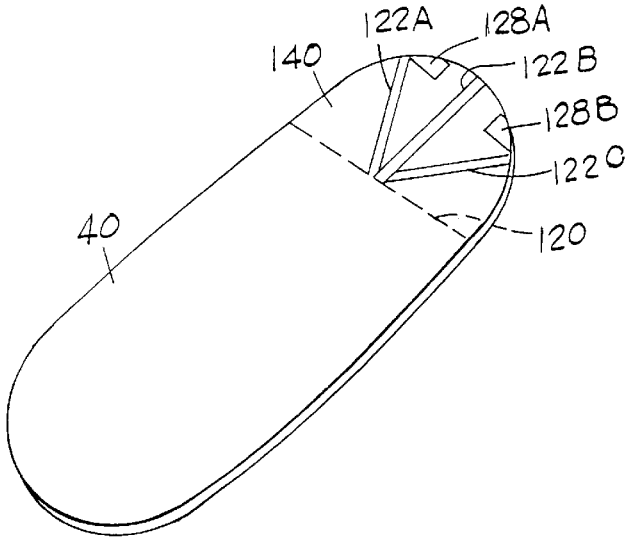
FIG. 7A is a back view of a mattress, showing a back seat support.
Figure 7B:
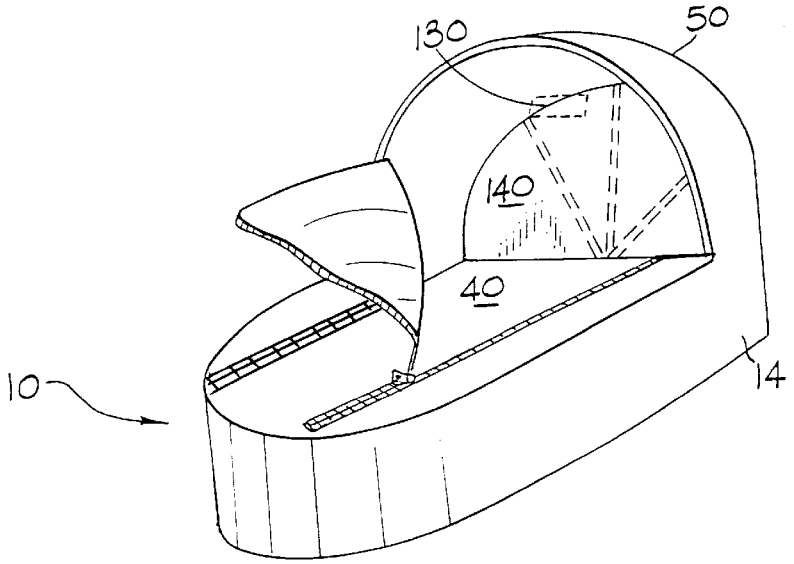
FIG. 7B is an interior view of the combination bed and carrier of this invention, showing the back seat support of FIG. 7A held in position.

As another advantage, the mattress pad unit 40 can be folded to create a seat for the infant. Referring to FIG. 7A, it may be seen that mattress pad 40 has a folding line 120 so that the mattress pad can be folded up to create a seat back 140. Pockets or channels 122 in seat back 140 hold fiberglass rods 124 (not separately shown or numbered in the drawing, but understood to be contained within the channels 122). In a preferred embodiment, three channels 122A, 122B, 122C are batten channels into which are inserted the corresponding fiberglass rods 124. VELCRO hook fastener tabs 128A and 128B are situated at the sides of the seat back 140. With reference now to FIG. 7B, it may be seen that VELCRO loop fastener tabs 130 held on the inside of the sidewalls 14 of the basket 10 can be moved around the head perimeter to adjust the seat angle and cooperate with the VELCRO tabs 128 of the seat back 140 to hold it into a baby seat position.

Bonnet 50 (see FIG. 1), may be removably attached to the basket 10 at the head thereof. The bonnet 50 includes a bonnet channel or pocket 52 which carries bonnet rod 54 (not separately numbered or visible in the drawing, but understood to be contained within channel 52). In a preferred embodiment, channel 52 is a hollow plastic welt into which is inserted a 1/16 inch flexible fiberglass rod 54. The bonnet 50 may be quilted for additional sound insulation and warmth, and includes hollow plastic welt channels 56 and rods 58 (not separately shown in the drawing, but understood to be contained within channel 56) for providing additional structural support.

A set of carrying straps 60, one strap 60A on the left and one strap 60B (not visible in the drawing) on the right side of the basket 10, are attached to rings 62 on the sidewall 14 of the basket. The straps 60 are sized and positioned slightly asymmetrically to one another, advantageously to provide a balanced grip when the basket is carried, free swinging, at an adult's side. A hand grip 64 (not shown) is secured to one of the straps 60 and slides for proper placement over the other strap.

A first embodiment of the modular, removable rocker stand 70 may be seen with reference to FIG. 2. A collapsible rocker stand is provided by the insertion of flexible bottom rocker rods 72A, 72B into paired pockets 74A and 74B on the bottom 12 of the basket 10, with at least one support and spacing rod 76 running between the rocker rods 72. In a preferred embodiment, the rocker rods 72 are one inch fiberglass battens and the pockets 74 are leather sheaths sized to receive the rocker rods 72, bending the rods 72 to provide the rocker shape. Support and spacer rod 76 is 3/16 inch fiberglass carried in channel or pocket 77 of a fabric flap 78 extending from edge to edge of the bottom 12 of the basket. A pair of hooks 80A, 80B, or like elements serve to secure the support and spacer rod 76 to each of rocker rods 72A, 72B. Using the rocker stand of this first embodiment, the bed will rock from head to foot.

A second embodiment of the modular, removable rocker stand 70 may be seen with reference to FIG. 3. A collapsible rocker stand is provided by bowing a number of rocker rods 82 across the bottom so that the bed rocks from side to side. As shown, two rods 82A and 82B are bent, curved metal radiused ends with swivel hooks (see 84A, 84B) are attached to the ends of the rocker rods with a ring, clip or screw, enabling the basket 10 to be clipped in. The radius rocker rods 82 are held rigid by two cross-members 86 which are easily unscrewed for ease in portability. Where the rocker rods 82 are sized so that they present an interior opening slightly larger than the width of the basket, the basket may be clipped in so that it is suspended within the rocker unit (the clips at 84A, 84B clipping to rings 62 of the basket 10), providing a lower center of gravity and a safety frame. Using the rocker stand of this second embodiment, the bed will rock from side to side.

Figure 4:
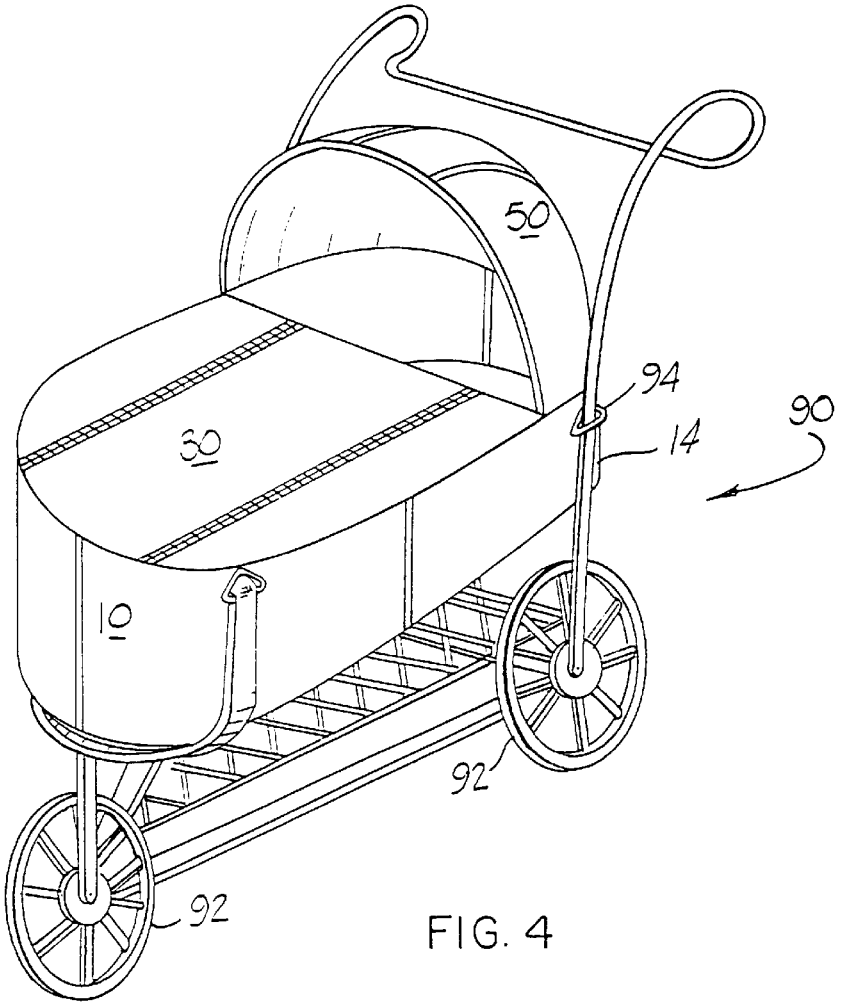
FIG. 4 is a perspective view, showing the stroller unit.

In addition to the two embodiments of the modular rocker stands 70 just discussed, optional modular accessory kits include, for example, a stroller stand 90 (with reference to FIG. 4). The stroller stand 90 is, preferably, a three-point stroller with three wheels 92. The stand 90 is modular so that the combination baby bed and carrier of this invention can be removably attached to it, using rings 62 or equivalent attachments at the sidewall 14 of the basket 10. It may be seen, therefore, that a three-wheeled stroller base 90 clips to the bassinet bed 10 so that the combination baby bed and carrier of this invention becomes an integral part of a stroller. The stroller base 90 is adopted to use wheel sets which are interchangeable, using a quick release system, from a six inch (or smaller) diameter size to a twenty inch (or larger) alloy rim for jogging.

Another modular accessory is a car bed unit to which the combination bed and baby carrier of this invention may be attached. Although not separately shown, it is readily understood that such a unit could be attachable to a seat of a vehicle using the preexisting seat belts, and that the bed and carrier would removably fasten to the car bed unit.

The combination baby bed and carrier of this invention is convertible to a backpack or papoose-style carrier as well. The conversion includes the use of a removable adult harness 100 (FIG. 8) to carry the bed on an adult's back, and the use of a removable infant harness 110 (FIG. 9) properly to support an infant when being carried backpack style.

Figure 8:
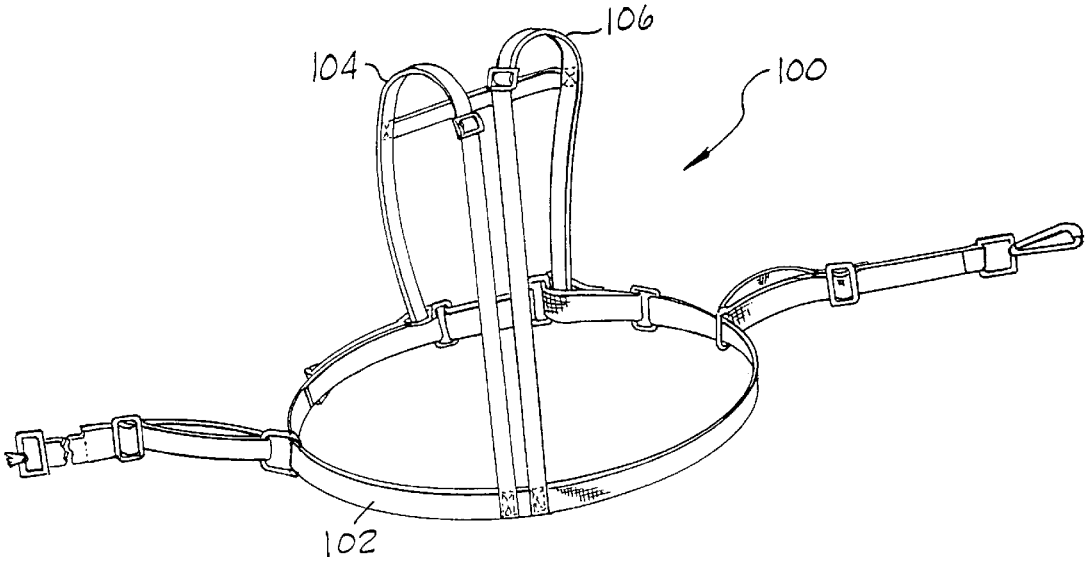
FIG. 8 is a perspective view of the removable adult harness for carrying the combination bed and carrier of this invention when converted to the backpack mode.

The adult harness 100 of FIG. 8 includes a belt 102 and shoulder straps 104, 106. With reference to FIG. 6 which is an exterior view of the bottom 12 of basket 10, a first pair of D-rings 118A and 118B can be understood to accommodate the belt 102 of adult harness 100 (FIG. 8). Likewise with reference to FIG. 6, a second pair of D-rings 118C and 118D can be understood to accommodate the shoulder straps 104 and 106 of adult harness 100 (FIG. 8). Thus, the adult harness 100 will strap the combination baby bed and carrier of this invention to an adult's back for carrying it backpack style.

Figure 5:
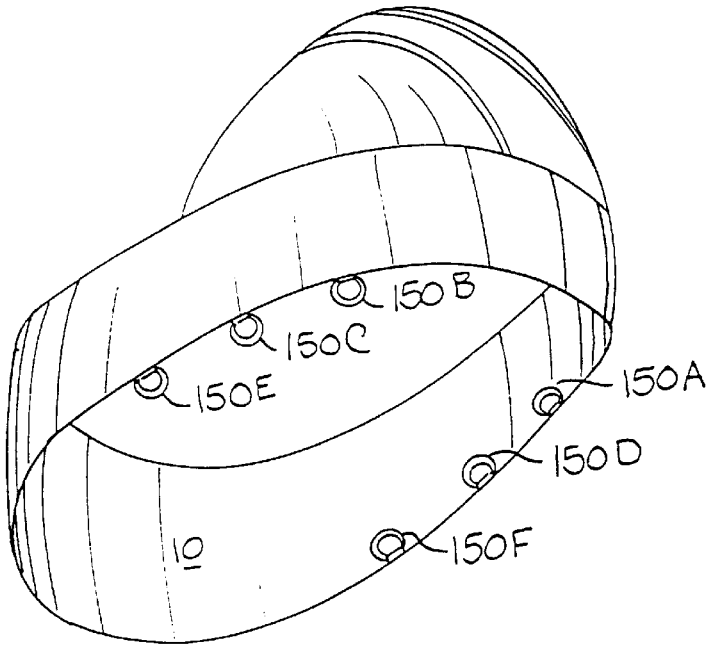
FIG. 5 is a bottom perspective, partially cut away view of the combination bed and carrier of this invention, showing details of the interior for attachment of the removable infant harness for supporting the infant when converted to backpack mode.
Figure 9A:
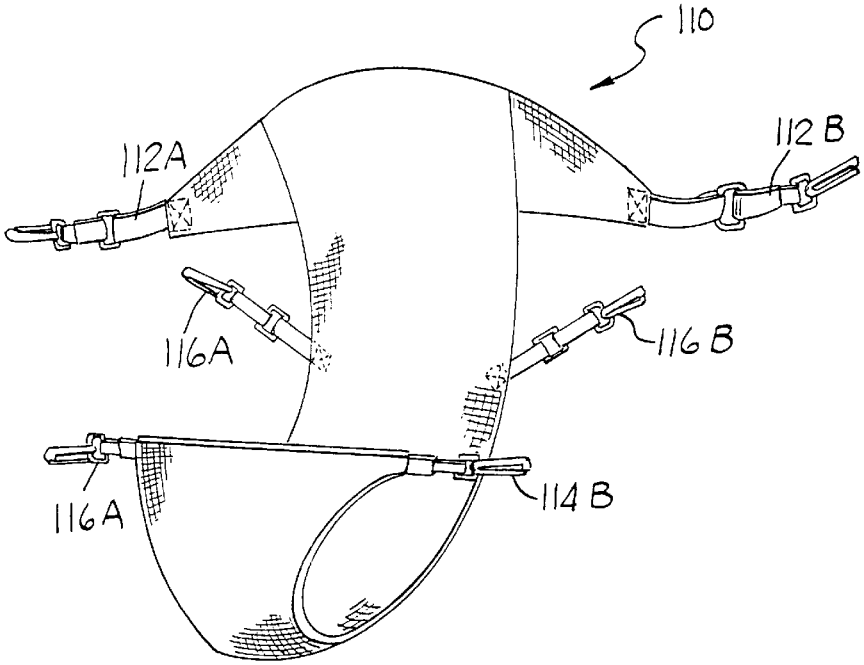
FIG. 9A is a perspective view of a first embodiment of the removable infant harness for supporting the infant when the combination bed and carrier of this invention is converted to the backpack mode.

The infant harness 110 of FIG. 9A includes a top support, with top support straps 112A and 112B; a bottom support with bottom support straps 114A and 114B; and a middle support with middle support straps 116A and 116B. With reference to FIG. 5 which is an interior view of the bottom 12 of basket 10, a first pair of D-rings 150A and 150B can be understood to accommodate the top straps 112A and 112B of infant support harness 110 (FIG. 9A). Likewise with reference to FIG. 5, a second pair of D-rings 150C and 150D can be understood to accommodate the middle straps 116A and 116B of infant support harness 110 (FIG. 9A). Finally, with reference to FIG. 5, a third pair of D-rings 150E and 150F can be understood to accommodate the bottom straps 114A and 114B of infant support harness 110 (FIG. 9A). The infant support harness can be reconfigured so as properly to hold the infant in place. For example, both of the middle straps 116 and the bottom straps 114 can be run through the second pair of D-rings (150C and 150D) to form a secure seat.

Figure 9B:
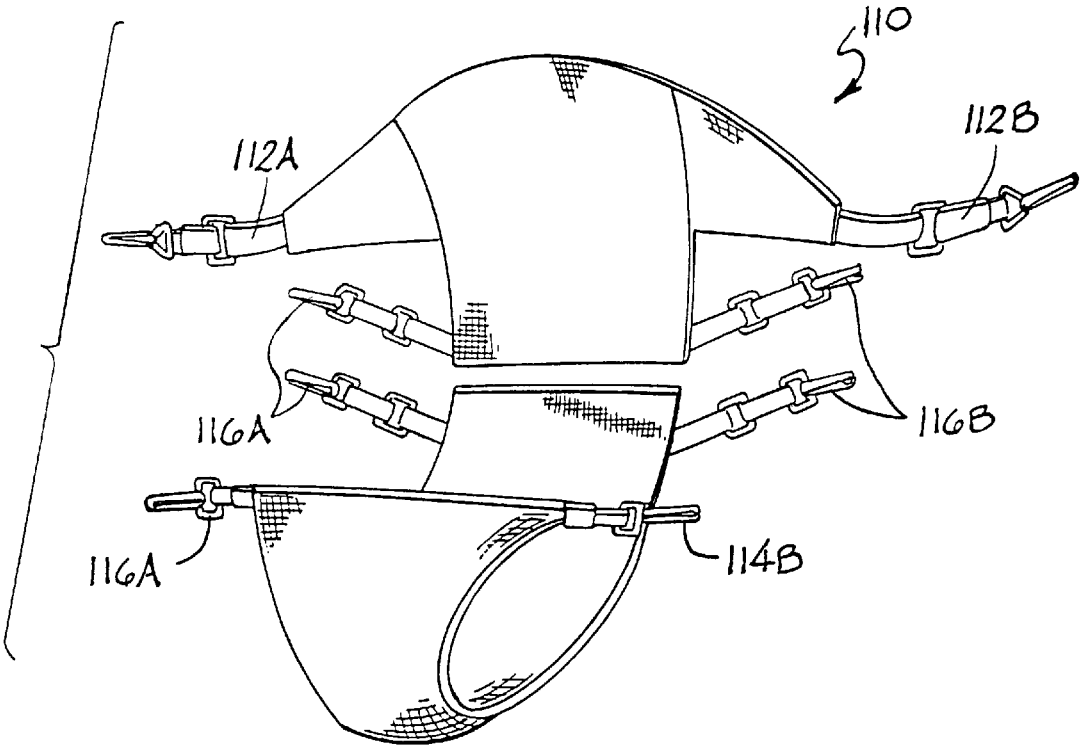
FIG. 9B is a perspective view of a second embodiment of the removable infant harness for supporting the infant when the combination bed and carrier of this invention is converted to the backpack mode.

Alternatively, a two-piece infant harness can be seen with reference to FIG. 9B. It can be readily understood that the upper body support piece and lower body support piece can be strapped into the D-rings 150 of basket 10 to provide a proper support to the infant in the backpack style of carrier.

Thus, the adult harness 100 will strap the combination baby bed and carrier of this invention to an adult's back for carrying it backpack style, and the infant harness 110 will support the infant in the carrier when it is used as a backpack. It should be understood that the bonnet 50 (FIG. 1) might be removed, and the top cover 30 closed, leaving the baby comfortably held inside with only his or her face showing.

The combination baby bed and carrier system of this invention is lightweight but very sturdy due to its fiberglass and fabric structure. Unlike other lightweight carriers on the market, the carrier of this invention has a semi-rigid structured shape which will not collapse about the baby. Unlike other structured carriers on the market, the structure of this invention does not come at the cost of heavy weight. As a result of its structural features, the carrier aspect of this invention is extremely versatile in use, being suitable for use at any location in the home; extremely easy to carry for travel with a baby inside; and easily converted from setup condition to collapsed condition without the use of tools, occupying minimum space and providing economy of storage.

The combination baby bed and carrier system of this invention is flexible, due to its highly engineered design using fiberglass rods and soft sides to create a semi-rigid yet soft sided structure. The carrier of this invention is rounded/oval in shape. There are flexible rods, but no square or sharp edges and the whole structure is flexible and soft (soft sides, bottom and bonnet). This provides useful comfort, not only for the baby occupying the carrier, but for the adult who is carrying it. Fiberglass rods of varying lengths, widths, shapes and diameters, each weighing only ounces, are engineered to give the carrier of this invention its highly flexible structure. These features are useful in portability and collapsibility. Other carriers which are angular or rigid tend to bump or bang into the legs and thighs of the person carrying them. In addition, other carriers offer only minimal collapsibility because of the use of hard materials for the bottoms and sides; in contrast, the carrier of this invention can be folded and tucked away by removing some or all of the fiberglass rods.

The combination baby bed and carrier system of this invention is durable and configurable due to the use of CORDURA, heavy polyester or canvas fabrics, together with adjustable shoulder straps. The inventors highly recommend the use of durable, waterproof fabrics to create a more functional, easier to clean, and more long-lasting product (compared to the typical light cotton, light polyester or rattan used in the common, completely soft sided lightweight carriers seen today). Moreover, the selection of such structural components as are used in the carrier of the present invention dramatically increases the functionality of the product by, in combination with the structural quality of the handle webbing coupled with the use of acetyl plastic hardware, permitting the safe carriage of a child up to 60 pounds compared to many existing lightweight products which can carry only up to about 20 pounds. The carrier of this invention can, therefore, expect to provide a much longer useful life and greater service.

Finally, and again as a recommendation for a better mode within which to practice the carrier of this invention, the inventors strongly urge the use of designer fabrics on the interior wall of the basket. The use of well-chosen designs, including whimsical, stimulating brilliant colors, shapes and characters provide a more stimulating and pleasant environment for the baby.

It has now been explained that the lightweight, collapsible combination baby carrier of this invention uses fiberglass rods to impart rigidity, yet collapses to 30 inches by 12 inches by 3 inches (or smaller) and weighs 2.5 pounds or less, not including accessories.

The combination baby bed and carrier system of this invention uses specially balanced handles for ease of carrying in a free swinging manner at an adult's side, or at the shoulders. It is soft sided yet semi-rigid and creates a comfortable womb-like environment for an infant and, in a preferred embodiment, includes a sheepskin lining. Its fiberglass frame and fabric construction allows it to carry up to 60 pounds. It converts to a baby-backpack so that the baby may be strapped to the mother's back or chest and carried that way as well. It is modular, and has clip-on compatibility with a number of other accessories so that it can function as rocker, stroller, crib or car seat.

It should be understood that the various sizes and materials recited herein are representative only and that the invention clearly embraces such substitutions as hard plastic or other material having light weight and flexibility features for the fiberglass rods discussed herein; that the diameters of the rods can be varied as desired; and that other such substitutions or adjustments are likewise contemplated and well known to those in this field.

Another Modular Rocker. In addition to the rocker assemblies already described, yet another light-weight modular rocker assembly may be understood with reference to FIG. 10.

In overview, it may be seen that a dome assembly 200 is joined to a base assembly 208 to form a dome shaped modular rocker structure for the baby basket 10 of this invention. The baby basket 10 is suspended within the dome assembly from the rings 62 of the basket using suspension straps 216.

Figure 13:
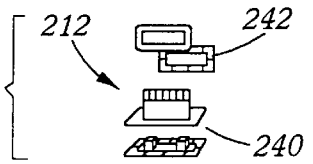
FIG. 13 is a perspective, exploded view showing details of turn buckle connector used in the modular rocker stand of FIG. 10.

The dome assembly 200 is formed by way of a first flexible and bendible dome rod 202 connected to a second flexible and bendible dome rod 204 at connector 206. The base assembly 208 is formed by a first base piece 210 connected to a second base piece 212 at connector 214 (not shown in FIG. 10, but seen in FIGS. 11 and 13).The baby basket 10 is suspended within the dome assembly. The result is a dome-shaped modular rocker structure for the basket.

Figure 11:
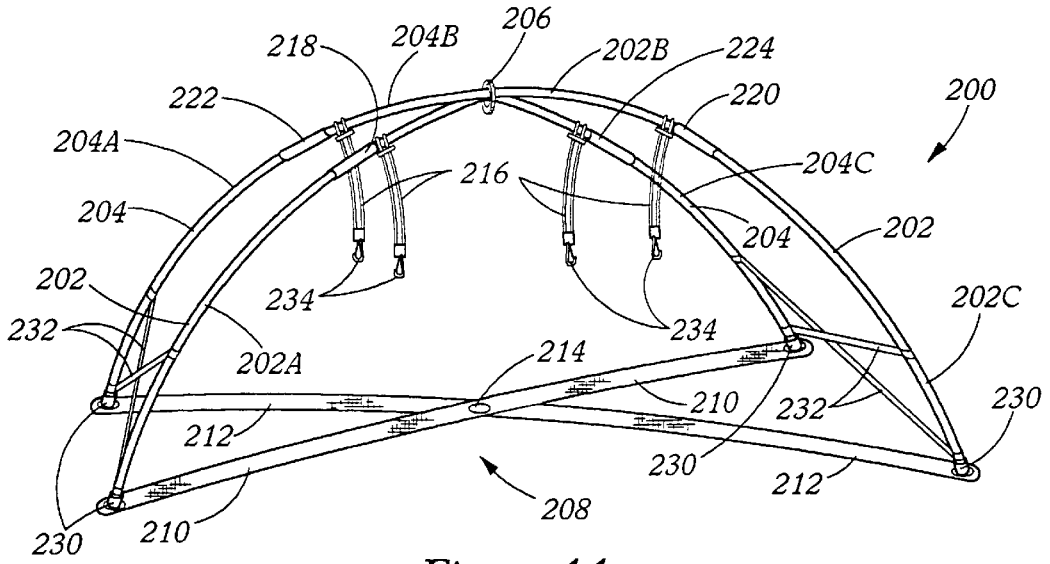
FIG. 11 is a perspective view showing details of the modular rocker stand of FIG. 10.

With reference now to FIG. 11, additional details of the modular rocker structure may be seen. In the discussion which follows, it should be understood that a particularly advantageous embodiment of the rocker structure is one which is light weight, portable, and easy to assemble and disassemble so that it can be put together readily in such places as a restaurant, workplace, the home of a friend, or elsewhere. Accordingly, such an embodiment will be discussed, it being understood that the rocker structure could also be made of heavier, nonportable materials, and could be made semi-permanent.

With reference to FIG. 11, the dome assembly 200 is formed by way of a first flexible and bendible dome rod 202 connected to a second flexible and bendible dome rod 204 at connector 206. To effect a smaller package when disassembled, each of the first and second dome rods, 202 and 204, are formed of three sectional pieces. The first dome rod 202 is formed of sectional pieces 202A, 202B and 202C. The sectional pieces 202A, 220B and 202C are joined together by external ferrules 218 and 220 in a telescoping friction fit. Ferrule 218 joins sectional pieces 202A and 202B; ferrule 220 joins sectional pieces 202B and 202C. To aid in the assembly, a tension line elastic chord (not shown) is threaded through the center of the sectional pieces and ferrules so that the sections, when pulled apart, are still loosely connected to one another.

In similar manner, dome rod 204 is formed of sectional pieces 204A, 204B and 204C. The sectional pieces are joined by external ferrules 222 and 224 in a telescoping friction fit. Ferrule 222 joins sectional pieces 204A and 204B; ferrule 224 joins sectional pieces 204B and 204C. To aid in the assembly, a tension line elastic cord (not shown) is threaded through the center of the sectional pieces and ferrules so that the sectional pieces, when pulled apart, are still loosely connected to one another by the cord.

Dome rods 202 and 204 are connected to one another at connector 206. In a preferred embodiment, dome rods 202 and 204 are hollow, 7.9 mm fiberglass rods, and connector 206 is a rubber (buna) O-ring. The rubber O-ring permits an additional degree of flexibility so that the rods, when disassembled, are still loosely connected to one another by the O-ring and yet the sectional pieces of the rods may be aligned parallel for more compact storage in a tubular storage sleeve.

Figure 12:
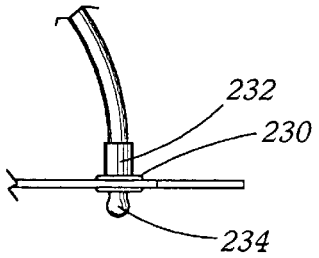
FIG. 12 is a perspective view showing details of an end connection used in the modular rocker stand of FIG. 10.

The base assembly 208 is formed by a first base piece 210 connected to a second base piece 212. In a preferred embodiment, the base pieces 210 and 212 are one-inch web fabric, which permits the pieces to be readily folded for convenient disassembly and storage. Connector 214 joins the base pieces 210 and 212 at their centers. In a preferred embodiment, connector 214 includes an acetyl turnbuckle unit 240 (reference FIG. 13) on one of the base pieces and a mating receptacle unit 242 (reference FIG. 13) on the other of the base pieces, but any other suitable releasable connector may be used. With reference again to FIG. 11, at the ends of each of base pieces 210 and 212 are holes which are reinforced by grommets 230. The four grommets 230 are sized to receive the ends of the dome rods 202 and 204. In a preferred embodiment, 3/8inch grommets are used, and the ends of the dome rods 202 and 204 are each enclosed with an aluminum sleeve 232 (reference FIG. 12) and capped with a rubber cap peg tip 234 (reference FIG. 12) to hold the rod in place through the grommet.

Figure 10:
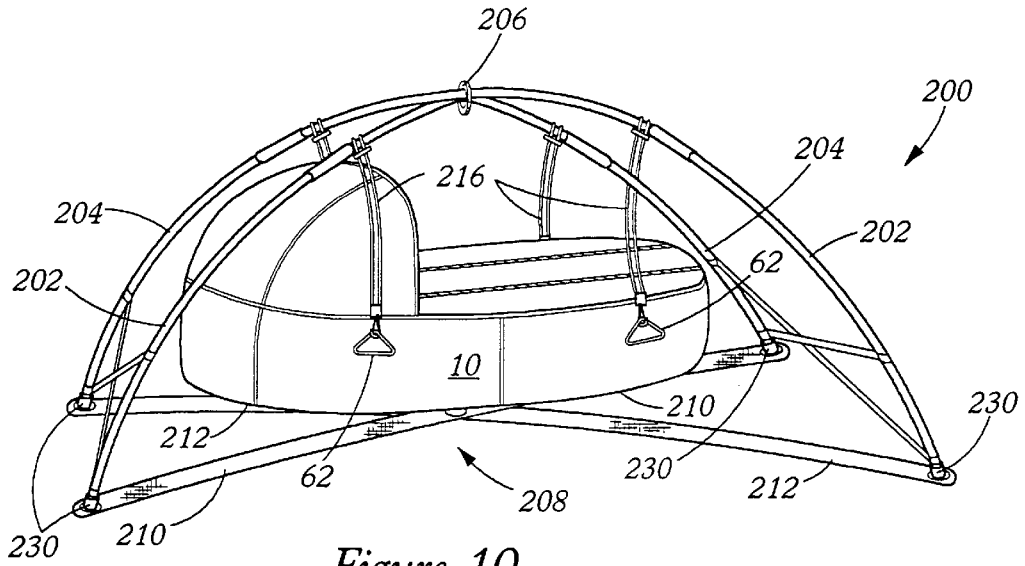
FIG. 10 is a perspective view of the combination baby bed and carrier of this invention, showing another embodiment of a modular rocker stand.

With reference now to FIGS. 10 and 11, it may be understood that the rocker assembly maintains a dome shaped structure when in use as follows (the following description summarizes the rocker, with attention to the tension provided to the dome assembly 200 by the base assembly 208 to maintain the structure of the rocker).

It will be recalled that the base assembly 208 consists of first and second flexible base pieces 210 and 212, joined at their centers by connector 214. In a preferred embodiment, the base pieces are web fabric, which can be oriented in the shape of an "X" by way of the center connector. The end of each of the base pieces 210 and 212 contains a grommet 230. By way of these grommets, the base assembly is attached to the dome assembly—an end of the dome assembly rods 202 and 204 is inserted into each of the grommets 230 and held in place by rubber cap 234.

The base pieces 210 and 212 are spread out to form an X-shape, and they are sized relative to the dome assembly so as to serve to create sufficient tension on the dome rods 202 and 204 to form a dome shape, with the center of the dome securely maintained by O-ring 206. Suspension straps 216 are, in a preferred embodiment, 3/32 inch nylon parachute cord, looped and locked in place at the ferrules (or other protruding device) on the dome rods. A hook 234 at the end of each of the suspension straps attaches to a corresponding ring 62 of the baby basket 10.

Optionally, additional structural support can be supplied by the addition of cross struts 232 (FIG. 11), which may be formed of cord, fabric sleeve, or a rod.

In a preferred embodiment, the rocker is assembled by:

unfolding the three sectional pieces 202A, 202B, 202C of the first dome rod and inserting each piece into the corresponding ferrule (218 and 220), and unfolding the three sectional pieces 204A, 204B, 204C of the second dome rod and inserting each piece into the corresponding ferrule (222 and 224), creating two straight, flexible dome rods (202 and 204) which cross in the center at connector 206;

arranging the web fabric of the first and second base pieces 210 and 212 by straightening the web fabric (if twisted), pulling the first and second base pieces together at their centers, and attaching the first and second pieces by use of the turnbuckle connector 214;

adjusting the dome assembly 200 formed by the first and second dome rods above the base assembly formed by the first and second base pieces (the dome rods are already connected to the base pieces at the grommets 230 by way of rubber caps 234 attached through the base piece and seated in the sleeves 232 of the dome rods);

adjusting the four suspension straps 216 so that each of them hangs downwards from the top edge of the corresponding ferrules 218, 220, 222, 224;

hanging the baby bed from the hooks 234 of the suspension straps 216, ensuring that the straps are out of the reach of a baby in the bed.

The rocker is disassembled by:

removing the baby bed from its hanging position;

carefully opening the turnbuckle connector 214, releasing the first and second base pieces 210 and 212 and releasing the tension on the dome rods 202 and 204;

pulling each the dome rods 202 and 204 apart by pulling the sectional pieces (202A, 202B, 202C and 204A, 204B, 204C respectively) out of the ferrules;

folding the rods and webs so that the rods are parallel to one another (each of the dome rods having been disassembled into three sections connected by elastic cord; and inserting the pieces in a tubular sack (in a preferred embodiment, all of the pieces are fitted into a tubular sack which is about 30 inches long, and about 3 inches in diameter).

In a preferred embodiment, assembly is greatly aided by the fact that, even when disassembled, the three sections of each of the dome rods 202 and 204 are strung together by elastic cord; the two dome rods 202 and 204 are connected to one another by rubber O-ring connector 206; and each of the dome rods 202 and 204 are connected, at their ends, to the ends of the base pieces 210 and 212 at the grommets 230. Thus, erection of the rocker structure is effected by joining the sections of the dome rods together (at the ferrules), joining the base pieces at their center (by turnbuckle 214), and popping up the dome by the tension supplied by the base.

The rocker structure is light weight (about 8 ounces in a preferred embodiment), fits into a compact tubular container, or nylon sleeve (about 30 inches long and 3 inches in diameter), and is easily portable and readily set up and broken down.

What is claimed is:

1. A baby bed and rocker unit, comprising:

(a) a basket, having an elliptical closed bottom, an elliptical open top, and a sidewall; wherein the basket is semi-rigid, being formed of a fabric supported by a first set of semi-rigid support rods carried therein, the basket being convertible to a backpack style carrier, and further comprising: (i) an adult carrying harness removably attachable to the basket, and (ii) an infant supporting harness removably attachable to the basket; and (b) a rocker unit having a dome assembly supported by a base assembly, and a set of straps suspended from the dome assembly to hold the basket, wherein the dome assembly includes a first dome rod and a second dome rod joined together by a dome rod connector; and the base assembly includes a first base piece and second base piece joined together by a base piece connector.

2. The unit of claim 1, wherein each of the first and second dome rods are formed of at least two sections, said sections of each rod being connectable to one another to form each such rod.

3. The unit of claim 2, wherein said sections of each rod are connected to one another by an elastic cord.

4. The unit of claim 3, wherein said sections of each rod are connectable to one another to form each such rod at a ferrule.

5. The unit of claim 4, wherein the dome rod connector is a flexible O-ring.

6. The unit of claim 1, wherein the first base piece and second base piece are formed of a flexible material, and the base piece connector is releasable.

7. The unit of claim 6, wherein the first base piece and second base pieces are formed of web fabric, the base piece connector joins them together at their centers, and the base assembly describes an "X" shape.

8. The unit of claim 7, wherein the base piece connector includes a turnbuckle.

9. A rocker unit for holding a baby bed, said unit comprising:

(a) a dome assembly supported by a base assembly, and (b) a set of straps suspended from the dome assembly to hold the baby bed, wherein the dome assembly includes a first dome rod and a second dome rod joined together by a dome rod connector; and the base assembly includes a first base piece and second base piece joined together by a base piece connector.

10. The unit of claim 9, wherein each of the first and second dome rods are formed of at least two sections, said sections of each rod being connectable to one another to form each such rod.

11. The unit of claim 10, wherein said sections of each rod are connected to one another by an elastic cord.

12. The unit of claim 11, wherein said sections of each rod are connectable to one another to form each such rod at a ferrule.

13. The unit of claim 12, wherein the dome rod connector is a flexible O-ring.

14. The unit of claim 9, wherein the first base piece and second base piece are formed of a flexible material, and the base piece connector is releasable.

15. The unit of claim 14, wherein the first base piece and second base pieces are formed of web fabric, the base piece connector joins them together at their centers, and the base assembly describes an "X" shape.

16. The unit of claim 15, wherein the base piece connector includes a turnbuckle.

* * * * *